United States Patent [19]

Scott

[11] 4,300,975

[45] Nov. 17, 1981

[54] STABILIZED LABELLING OF OBJECTS

[75] Inventor: Robert J. Scott, Framingham, Mass.

[73] Assignee: Dennison Manufacturing Company, Framingham, Mass.

[21] Appl. No.: 149,873

[22] Filed: May 14, 1980

Related U.S. Application Data

[63] Continuation of Ser. No. 847,185, Oct. 31, 1977, abandoned, which is a continuation-in-part of Ser. No. 512,856, Nov. 7, 1974, abandoned.

[51] Int. Cl.[3] ..... B65C 9/02; B65C 9/04

[52] U.S. Cl. ..... 156/456; 156/458; 156/542; 156/567; 156/DIG. 25; 156/DIG. 26; 198/345; 198/472; 269/47; 269/50; 269/56; 269/57

[58] Field of Search ..... 156/446, 448, 449, 456, 156/458, 542, 556, 566, 567, 558, DIG. 12, DIG. 13, DIG. 18, DIG. 25, DIG. 26; 269/47, 49, 50, 51, 56, 57, 908-909; 198/792, 472, 473, 345

[56] References Cited

U.S. PATENT DOCUMENTS

| | | | |
|---|---|---|---|
| 2,727,647 | 12/1955 | Luthi | 156/458 |
| 3,058,514 | 10/1962 | Flood | 156/566 |
| 3,064,714 | 11/1962 | Flood | 156/567 |
| 3,650,373 | 3/1972 | Kern et al. | 198/345 |

*Primary Examiner*—Michael G. Wityshyn
*Attorney, Agent, or Firm*—George E. Kersey

[57] ABSTRACT

Objects to be labelled with, for example, heat transfer labels, are initially stabilized by being positioned on freely movable platforms and conveyed to a station where the platforms are stabilized and the objects labelled.

12 Claims, 4 Drawing Figures

STABILIZED LABELLING OF OBJECTS

This is a continuation of Ser. No. 847,185, filed Oct. 31, 1977, abandoned, which is a continuation-in-part of Ser. No. 512,856 filed Nov. 7, 1974, abandoned.

BACKGROUND

The invention relates to the labelling and decoration of objects and, more particularly to the stabilized labelling and decoration of objects.

In the labelling and decoration process, objects such as containers and the like are transported to various stations where processing takes place before, during and after labelling.

Unless there is proper coordination between the transport of the containers and the operations at the various processing stations, the labels will be improperly applied.

For example, if there is any wobble in the containers, any pre-labelling and post-labelling surface treatments will be erratic. And it is particularly important for the containers to be fully stabilized at the precise moment a label is applied. Otherwise there will be misalignment, which in the case of heat transfer labels, can result in smearing.

Two common systems for the stabilization of containers in heat transfer labelling are disclosed in Flood U.S. Pat. No. 3,058,514 issued Oct. 16, 1962, and Flood U.S. Pat. No. 3,064,714, issued Nov. 20, 1962.

In U.S. Pat. No. 3,058,514, containers to be labelled are secured in position by supports that are incorporated as an integral part of a conveyor. The supports are helpful in stabilizing the containers during pre-labelling and post-labelling operations, as well as during the actual labelling. In particular they allow the labelling with respect to axes that would otherwise be unstable. For example, the supports can hold long narrow containers, such as enclosures for cigars, in a vertical position. As a result the containers are stabilized with respect to a longitudinal axis that would be unstable if the supports were not employed.

However, because the supports in U.S. Pat. No. 3,058,514 are linked to the conveyor, there is an inevitable amount of "play", or relative movement. As a result, the rate of feed of the conveyor must be restricted in order to avoid excessive wobble at the pre- and post-labelling stations, and particularly at the labelling station.

In addition, the spacing of the supports is fixed. Not only does the system not lend itself to any variation in the spacing of containers during transport, it is also necessary to change the supports and modify the conveyor whenever there is a change in the configuration of the containers.

In U.S. Pat. No. 3,064,714 objects to be labelled are transported by a feed conveyor to a turret where a measure of stabilization is achieved, in effect, by clamping each container before it is rotated to receive a label. No other stabilization is provided.

This arrangement is usable with containers that, because of configuration, do not require much stabilization, but it is completely unsuitable for containers which are not inherently stable, such as those which require support. And like the system of U.S. Pat. No. 3,058,514, that of U.S. Pat. No. 3,064,714 must have a limited rate of feed in order to assure that reasonably proper stabilization will occur at the labelling station. Otherwise there can be excessive wobble before, during and following labelling.

Accordingly it is an object of the invention to expedite the processing of containers. A related object is to expedite the heat transfer labelling of containers.

A further object of the invention is to increase the speed and efficiency of container processing. A related object is to increase the speed and efficiency of the heat transfer labelling of containers.

Still another object of the invention is to enhance the stability of containers during processing. A related object is to enhance the stability of containers during heat transfer labelling.

A further object is to increase the versatility of systems for the processing of containers. A related object is to increase the versatility of systems for the heat transfer labelling of containers.

A yet further object is to accommodate a wide variety of container configurations and axes, including those that are inherently unstable.

Still another object of the invention is to stabilize objects without the need for conveyors with integrally included support members. A related object is to achieve the stabilized transport of containers without the need for complex conveyor linkages.

SUMMARY OF THE INVENTION

In accomplishing the foregoing and related objects, the invention provides for the use of a freely movable platform to stabilize each object to be labelled. The objects thus stabilized are transported on their platforms to a station where labels are applied.

In accordance with one aspect of the invention, the platforms are stabilized during the course of their transportation to the labelling station. This can be accomplished by applying pressure to the platforms.

In accordance with another aspect of the invention, the objects are transported by conveyors to a turret where the platform are stabilized by spring loaded fingers.

In accordance with still another aspect of the invention, the labels are applied by moving the objects, with their platforms, relative to a label carrying web, for example by rotating the objects and their platforms.

In accordance with a further aspect of the invention the objects to be labelled and their associated platforms are conveyed at different rates of speed to the labelling station. This permits the objects to be loaded continuously on an input conveyor, spaced properly for pre-labelling and post-labelling operations, and continuous unloading from an output conveyor.

In accordance with a still further aspect of the invention the objects and their platforms are conveyed to an indexable turret which removes the objects from the conveyor and moves them through a plurality of stations, including a labelling station, and returns them to the conveyor.

DESCRIPTION OF THE DRAWINGS

Other aspects of the invention will become apparent after a consideration of several illustrative embodiments taken in conjunction with the drawings in which.

DETAILED DESCRIPTION

Figure 1:
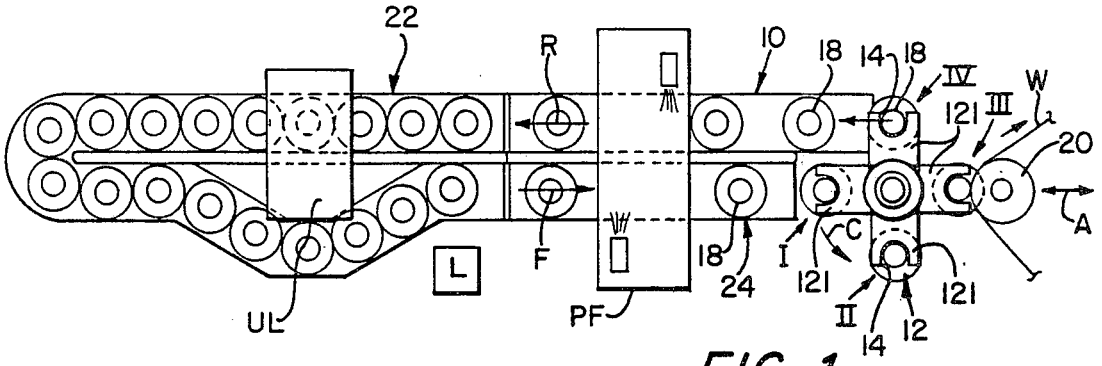
FIG. 1 is a plan view of a stabilized labelling system in accordance with the invention.

Turning to the drawings, in the stabilized labelling system of FIG. 1, containers 18 to be labelled are applied to an input and output belt conveyor 22 at a loading station L.

The containers 18 are then transported by a second belt conveyor 10-1 in a feed direction F through a pre-labelling processing station PF to a labelling turret 12. In the case of heat transfer labelling the pre-labelling station is used to flame the containers 18 in order to prepare their surfaces for facilitating the application and retention of heat transfer labels at the labelling station of the turret 12.

At the turret 12 individual ones of the containers 18 are fed successively into a guide extension 14 at a receiving station I. Each received container is indexed in a counterclockwise direction C to a holding station II; and then to a print station III where each container 18 is labelled. This is accomplished by moving the container relative to and in contact with a label carrying web W. In the case of heat transfer labels a heated and rotating platen 20 is brought reciprocally in the indicated direction A into contact with the web W in order to apply a label to the rotating container at the print station III.

Once the label is applied at the labelling or print station III, the turret 12 is indexed to a discharge station IV and the labelled container is applied to a second conveyor 10-2 for feed through a post-labelling station PF′ in a return direction R. In the case of heat transfer labels the post-labelling station PF′ can be used to apply a post-flaming surface treatment to the applied labels.

At the end of the path of the return conveyor 10-2, the containers 18 are transferred to the output conveyor 22 so that they can be removed from the system at an unloading station UL.

The labelling system of FIG. 1 can be used for labelling objects with respect to unstable axes, which have heretofore required a conveyor arrangement of the type shown in Flood U.S. Pat. No. 3,058,514. At the same time the system of FIG. 1 can be used for improved labelling in systems of the kind shown in Flood U.S. Pat. No. 3,064,712.

Figure 2:
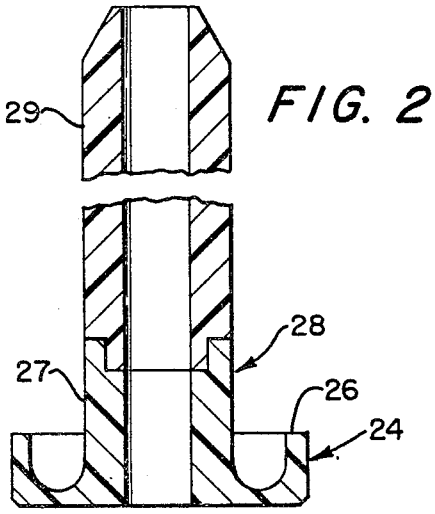
FIG. 2 is a sectional view of an illustrative platform for the stabilized labelling system of FIG. 1.
Figure 4:
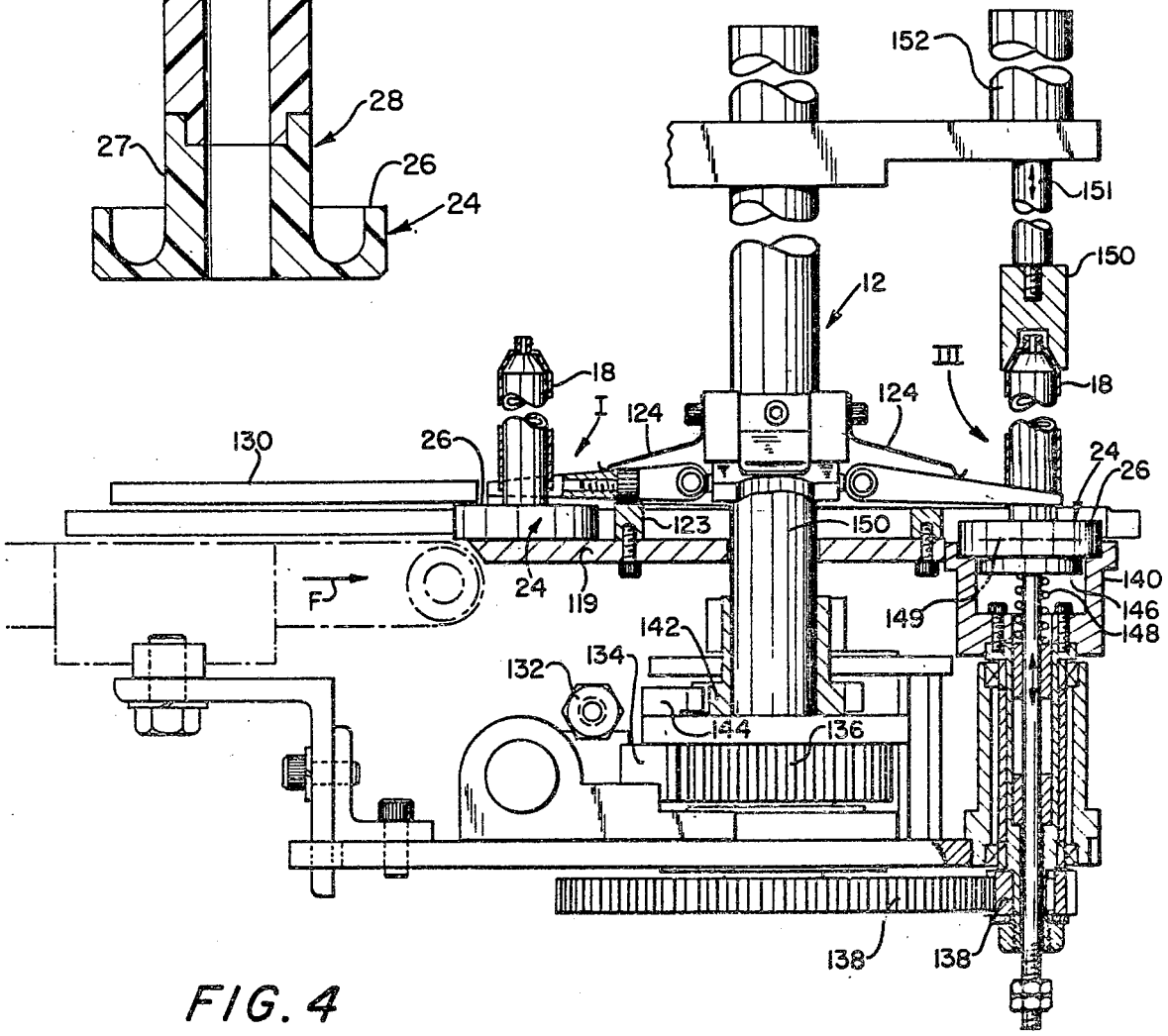
FIG. 4 is a cross-sectional view of the labelling turret of FIG. 3.
Figure 3:
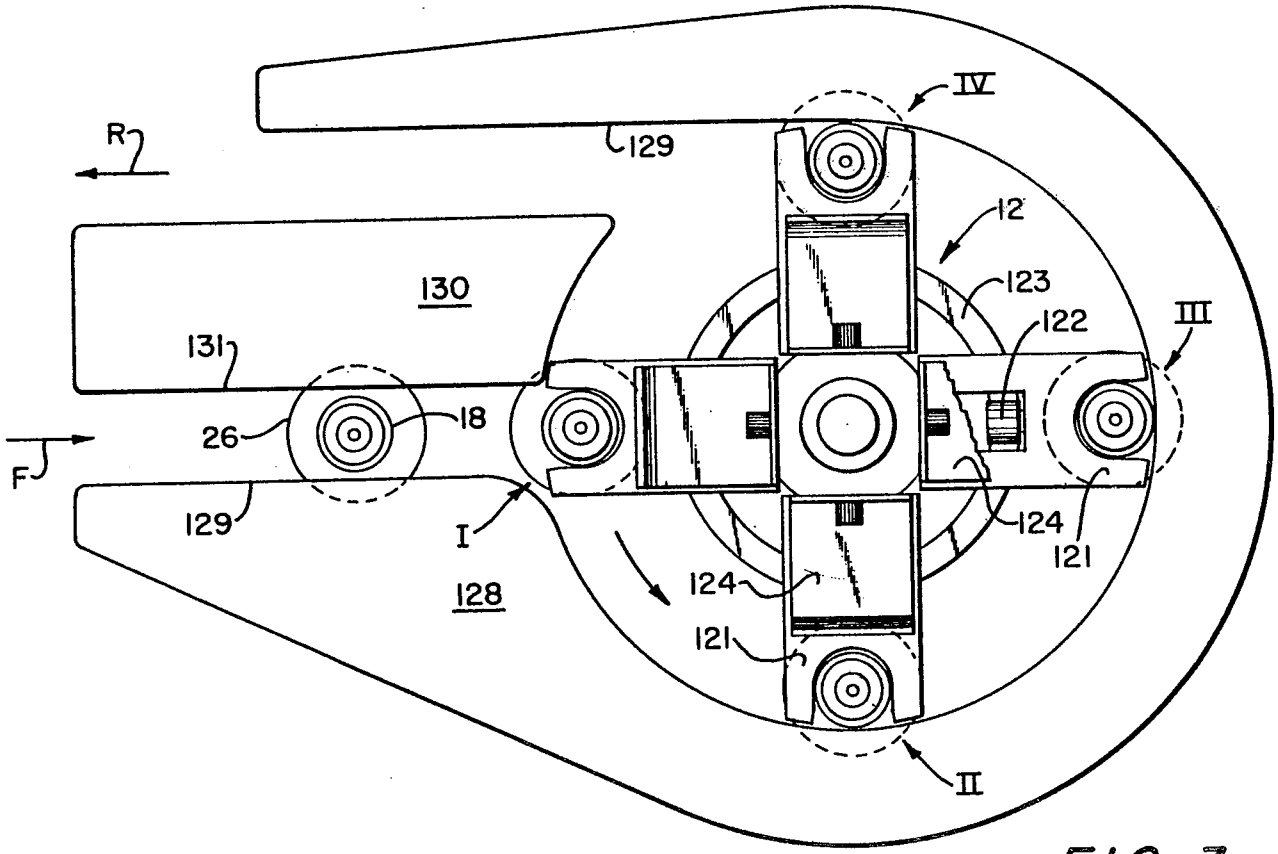
FIG. 3 is a plan view of a labelling turret for the stabilized labelling system of FIG. 1.

The system of FIG. 1 is able to achieve stabilized labelling, regardless of the type of container to be labelled, and without the need for special conveyor belting, by using a stabilizing platform 24 of the kind shown in FIG. 2, taken in conjunction with a stabilizing turret of the kind shown in FIGS. 3 and 4.

In addition to container stabilization the system of FIG. 1 permits high speed labelling. This is achieved by operating the feed and return belts 10-1 and 10-2, in conjunction with stabilizing platforms 24, at a comparatively higher rate than the input and output conveyor 22. In order to obtain proper pre-flaming and post-flaming treatment of the containers 18 at the stations PF/PFG′, a suitable spacing between containers over the flaming interval is required as indicated in FIG. 1. At the same time it is advantageous to be able to place the incoming containers at the loading station L on the input portion of the conveyor 22 in a successive and random manner. Because the stabilizing platforms 24 are not permanently affixed to any of the conveyors 22, 10-1, and 10-2, they can be spaced in accordance with the processing requirements at the various stations.

As indicated in detail in FIG. 2 the stabilizing platform 24 can be formed by a base 26 and an upward extension 28. Both the base and the extension can contain a passageway 25 to both lighten the platform 24 and permit the passage of air jets during one or more of the processing operations. The base 26 is desirably of universal design for each type of container to be processed in the system of FIG. 1, but the extension 28 is adapted to the particular container to be handled. For the illustrative stabilizing platform 24 of FIG. 2 the extension 28 is divided into two sections 27 and 29, both of which are removed for the stabilized processing in accordance with the invention of containers with closed bottoms that are nested within the base 26.

The turret 12 and appendages are shown in detail in FIGS. 3 and 4. The turret 12 has four forked extensions 121, each with a roller cam follower 122 that rides on a common cam ring 123. Leaf springs 124 force the forked extensions 121 to the profile of the cam ring 123. The ring 123 protrudes sufficiently above a fixed table 119 at stations I and IV to allow reception of incoming containers 18 with clearance between the base 26 of each stabilizing platform 24 and the forked extension 121 at the receiving station I. Similarly there is corresponding clearance at the discharge station IV. Beyond the receiving station I the cam ring 123 drops over a substantial arc at the holding station II and the print station III so that the leaf springs 124 force the tines of the guides 121 against the flanges 26 of the stabilizing platforms 24. As a result the platforms 24 ride upon and stabilize with respect to the fixed table 119.

Associated with the turret 12 are guide plates 128 and 130 shown in FIG. 3 which overlie the locus of movement of the bases 26 of the stabilizing platforms to prevent any tilting of the platforms 24.

The turret 12 is indexed by rotation of a shaft 150, shown in FIG. 4, which is driven by a four-toothed ratchet wheel 142 and a pawl 144 on backward strokes of a rack 134. The rack 134 is driven by a push rod 132 from a prime mover (not shown). The drive also actuates a pinion 136 and gearing 138 for rotating a cup base 140 to rotate the base 140 on forward strokes of the rack 134 at the labelling station III.

The cup base 140 has a bottom 146 which is desirably yieldable and seated on a spring 148. A cap 150 is mounted from a fixed structure at the labelling station III, and, as indicated by an arrow 151 is driven by a fixed air cylinder 152 to force each container 18 with its associated stabilizing platform 24 from the table height indicated by chain line 149 into the cup base 140. The container and platform assemblage is then gripped between fixtures 146 and 150 in rotary driving relationship with the cup 140.

The platforms 24 may be applied to usage with a wide variety of containers. In some cases, the portion 29 may be eliminated and an otherwise unstable container may be secured to the base portion 27. If the container is inherently stiff, e.g. a cigar tube or toothbrush tube, its top can be engaged by the cap 150 at print station III (FIG. 4). If the container is not sufficiently stiff, it can be made rigid at station III by directing a blast of air through floor piece 146. In most cases, it is preferred to have custom made pieces for the stabilizing platform to provide reinforcement. The arrangement of parts at the labelling station III makes the full length of a container available for printing and assures precise height registration.

The system is also usable for labelling containers without the aid of the stabilizing platforms 24. However, labelling of all types of containers is enhanced by use of the platforms 24 to provide each overall assemblage with a lower center of gravity than that of any individual container.

The system may also include rotational mechanisms at the post-flaming/pre-flaming stations PF/PF′ similar to what is employed at the labelling station III.

The stabilizing platforms 24 are also adaptable to all types of objects with closed surfaces by forming a suitable base recess surrounded by a rim. In addition, the stabilizing platforms 24 may be adapted to support an object at a prescribed angular orientation, for example, by the use of a block with an inclined face and a holder.

It will be apparent to those of ordinary skill in the art that numerous modifications can be made in the foregoing disclosure of the invention, which embraces all novel features within the scope and spirit of the appended claims.

What is claimed is:

1. Apparatus for labelling an object which comprises a conveyor, a freely movable platform on said conveyor and unconnected thereto for stabilizing the object, means for rotatably transporting said platform about an axis displaced therefrom, with said object to apply a label thereto, and means for applying pressure directly to said platform for the stabilization thereof during rotation.

2. Apparatus as defined in claim 1 wherein the transporting means includes a cam ring for controlling the application of pressure to said platform by the pressure applying means during the stabilization thereof.

3. Apparatus as defined in claim 2 wherein said transporting means has a plurality of stations and said cam ring is out of engagement with the pressure applying means at one of said stations.

4. Apparatus as defined in claim 3 wherein said one of the stations is an input station.

5. Apparatus as defined in claim 3 wherein said cam ring is in engagement with said pressure applying means at a second of said stations.

6. Apparatus as defined in claim 3 wherein said one of the stations in an output station.

7. Apparatus as defined in claim 2 wherein said cam ring is in engagement with said pressure applying means at one of the stations thereof.

8. Apparatus as defined in claim 2 wherein pressure is applied by leaf springs to force tines of guides against flanges of the stabilizing platforms.

9. Apparatus as defined in claim 8 further including guide plates which overlie the locus of movement of the stabilizing platforms on the transport means to prevent tilting.

10. Apparatus as defined in claim 1 wherein the stabilizing platform includes a base recess surrounded by a rim for accommodating objects.

11. Apparatus as defined in claim 1 wherein the transport means comprises a turret with a plurality of extensions, each with a roller cam follower that rides on a common cam ring.

12. Apparatus as defined in claim 11 wherein the turret has a different extension for each different station of the transport means including a first station for the receipt of incoming containers, a holding station preliminary to the imprinting of the containers, a print station where decorations are transferred to the containers, and discharge station where the labelled containers are released for further processing.

* * * * *